United States Patent [19]

Priem

[11] Patent Number: 4,838,338

[45] Date of Patent: Jun. 13, 1989

[54] MOLD CAVITY GAS REMOVAL SYSTEM WITH GAS FLOW INDICATOR

[75] Inventor: Barry L. Priem, Bedford, Ind.

[73] Assignee: General Motors Corporation, Detroit, Mich.

[21] Appl. No.: 174,572

[22] Filed: Mar. 29, 1988

[51] Int. Cl.[4] ..... B22D 17/70

[52] U.S. Cl. ..... 164/113; 164/305; 164/410; 425/420; 425/812

[58] Field of Search ..... 164/305, 113, 410, 254, 164/61, 65; 425/812, 420

[56] References Cited

U.S. PATENT DOCUMENTS 4,538,666 9/1985 Takeshima et al. ..... 164/410

4,722,385 2/1988 Yamauchi et al. ..... 425/812

*Primary Examiner*—Kuang Y. Lin

*Attorney, Agent, or Firm*—Douglas D. Fekete

[57] ABSTRACT

A gas removal system for a mold cavity of a die casting or other molding machine includes a vacuum line connecting the mold cavity to a vacuum pump when a valve therebetween is open to evacuate gas from the mold cavity prior to injection of molten material therein and further includes a gas flow indicator disposed in the vacuum line between the valve and vacuum pump. The gas flow indicator includes a mechanical flapper movable in a particular manner in response to evacuation of gases from the mold cavity and in another noticeably different manner when little or no gas is evacuated from the mold cavity as a result of the valve being improperly closed. The flapper is visible to a machine operator through a window to indicate whether the gas evacuation system is operative to remove gas from the mold cavity.

6 Claims, 2 Drawing Sheets

MOLD CAVITY GAS REMOVAL SYSTEM WITH GAS FLOW INDICATOR

FIELD OF THE INVENTION

The present invention relates to a system for evacuating gas from the mold cavity of a die casting machine or other molding machine and, in particular, to a gas evacuating system having a visible gas flow indicator disposed in the vacuum line through which evacuation occurs to indicate to a machine operator that the gas evacuation system is operative to remove gas from the mold cavity.

BACKGROUND OF THE INVENTION

It is known in the metal die casting industry to employ a gas evacuation system of the axial melt impingement type.

The system includes a valve movable to an open position where the die or mold cavity is in communication with a vacuum pump through a vacuum conduit or to a closed position where the mold cavity is not in such communication. As the gas evacuation system is engaged on the mold during normal operation after mold warm-up, the valve is moved to the open position by application of pneumatic pressure to a cylinder in which an extension on the valve is slidably received as a piston. After positioning in the open position, the valve is held in the open position mechanically by engagement of spring biased balls against an intermediate stem portion of the valve. Pneumatic pressure in the cylinder is discontinued once the valve is so engaged and held in open position. A molten charge is then injected into the mold cavity with gas in the cavity being evacuated from the mold cavity past the open valve. The valve is closed by impingement of the molten charge on the valve head after gas is substantially evacuated from the cavity.

Occasionally, the valve does not open properly prior to injection of the melt in the cavity and, no gas is evacuated from the mold cavity even though the vacuum pump has been actuated. A die casting having increased porosity may result in the event molten metal is injected into a mold cavity from which gas has not been evacuated.

There is a need for the machine operator to be able to determine quickly and easily if the gas evacuation system is operating properly to evacuate the mold cavity.

SUMMARY OF THE INVENTION

The invention contemplates a gas evacuation system for removing gas from the mold cavity of a die casting or other machine wherein the gas evacuation system includes a visible gas flow indicator in a vacuum conduit extending between the mold cavity and a vacuum source, such as a vacuum pump, employed to evacuate the mold cavity to indicate whether the system is operative to remove gas from the mold cavity.

The invention contemplates a gas evacuation system of the type described in the preceding paragraph wherein the gas flow indicator is disposed in the vacuum conduit between the vacuum source and a valve movable to an open position to interconnect the mold cavity and vacuum source through the vacuum conduit and wherein the gas flow indicator includes a flapper movable in a particular manner in response to evacuation of the mold cavity and window means for viewing movement of the flapper to indicate whether the evacuation system is operative.

In a typical working embodiment of the invention, the gas flow indicator comprises a hollow housing connected in the vacuum line or conduit between the valve and vacuum pump, a flapper disposed in the housing for movement in a particular manner in response to evacuation of gases from the mold cavity and a window on the housing through which a machine operator can view the manner of flapper movement to determine whether the gas evacuation system is operative. When the gas evacuation system is operative to evacuate gas from the mold cavity with the valve open, the flapper moves in one manner and when the system is not so operative as a result of the valve being improperly closed, the flapper moves in another noticeably different manner.

The invention also contemplates a method for evacuating gas from a mold cavity including the steps of interconnecting the mold cavity and a vacuum source by opening a valve disposed therebetween, positioning a movable flapper between the valve and vacuum source such that the flapper moves in a particular manner in response to evacuation of gases from the mold cavity, and applying a relative vacuum to the mold cavity to evacuate gases therefrom and to move the flapper in a manner indicating that gas is being evacuated from the mold cavity with the valve open.

BEST MODE FOR PRACTICING THE INVENTION

Figure 1:
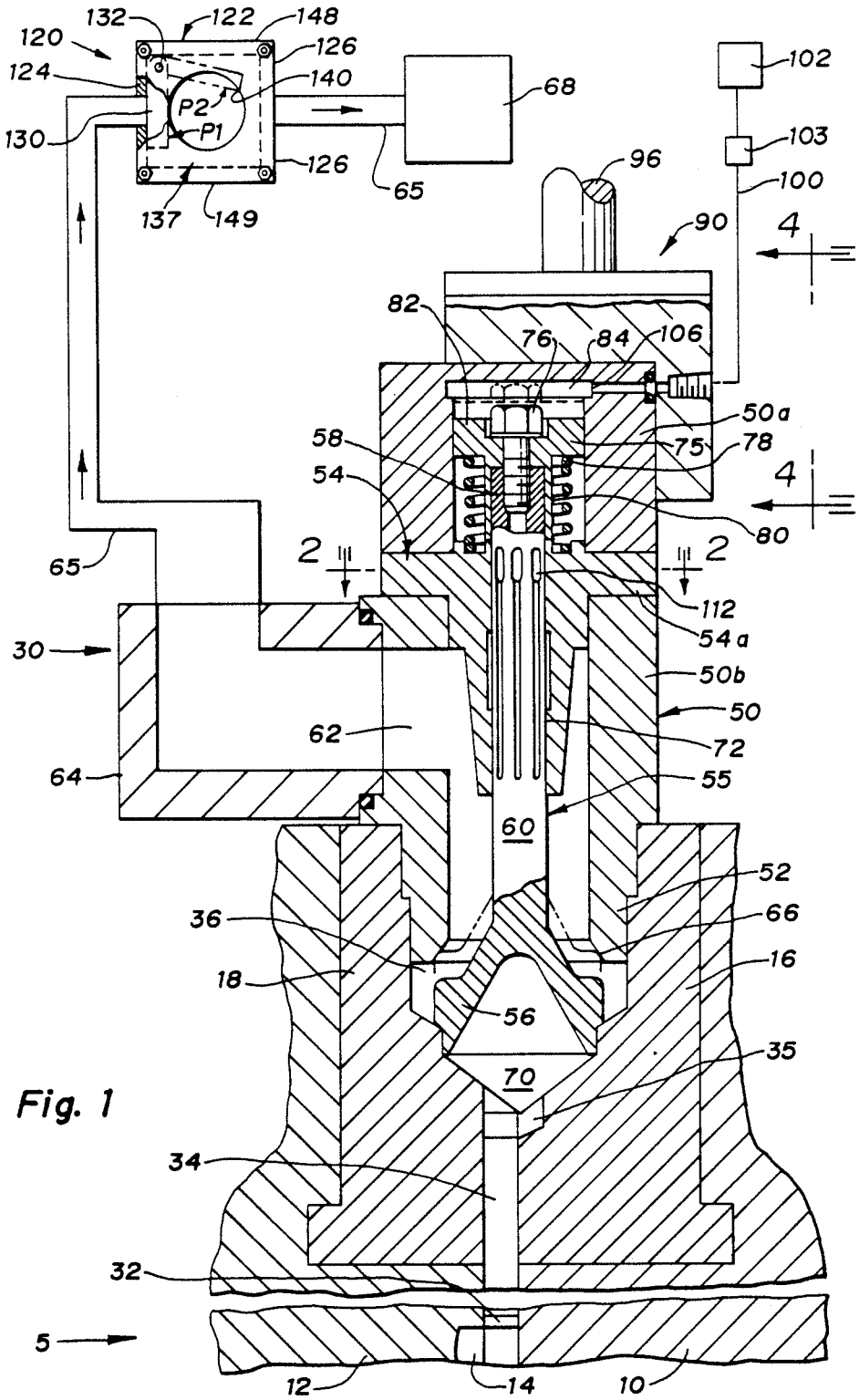
FIG. 1 is a somewhat schematic view of the gas evacuation system constructed in accordance with the invention with the valve and mold halves shown in section.

FIG. 1 illustrates a mold assembly 5 of a die casting machine. The mold assembly includes respective stationary and movable mold or die halves 10,12 which define a mold cavity 14 therebetween when closed together as shown. Mold halves 10,12 include respective seat members 16,18 which may be integral with the respective mold halves. Mold halves 10,12 and seat members 16,18 are carried on respective stationary and movable platens (not shown).

A gas evacuation system 30 is provided to evacuate gas from mold cavity 14. The system includes a first gas discharge passage 32 extending around and from the mold cavity 14 to a second gas discharge passage 34 that includes a pair of by-pass pasasges 35 (only one shown) detouring from the gas discharge passage 34 laterally of the valve head and extending to an upper gas discharge chamber 36 to effect gas flow communication between gas discharge passage 34 and upper gas discharge chamber 36. Such lateral passages are shown in further detail in the Takeshima et al U.S. Pat. No. 4,538,666 issued Sept. 3, 1985, the teachings of which are incorporated herein by reference. It is apparent that mold havles 10,12 cooperate to form discharge passage 32 therebetween while mold halves 10,12 and seat members 16,18 define discharge passage 34 therebetween. Gas discharge chamber 36 is defined between seat members 16,18.

The gas evacuation system also includes a valve housing or body 50 having end 52 received in gas discharge chamber 36 as shown. Valve body 50 includes upper portion 50a and lower portion 50b with a valve guide member 54 disposed therebetween. Movably disposed in the valve housing or body 50 is a valve 55 having a lower valve head 56, upper end 58 remote from the valve head and an intermediate valve stem 60. Valve body includes a gas discharge chamber 62 that extends through extension 64 on the valve body to a vacuum conduit or line 65 which interconnects vacuum source such as vacuum pump 68 and the chamber 62 to evacuate gases from cavity 14 through conduit 65 and gas discharge passages/chambers 32,34,36,62 (which comprise an extension of the vacuum conduit 65) when the valve is open and the pump is actuated. Valve body 50 includes a valve seat 66 that cooperates with the valve head 56 when the valve is in the closed position shown in phantom in FIG. 1 to prevent interconnection of gas discharge chamber 36 to gas discharge chamber 62.

Movement of valve 55 between the open and closed positions is guided by valve guide member 54. The guide member includes a central axial bore 72 slidably receiving intermediate valve stem 60 to this end. The valve guide member is fastened between the upper and lower portions **50*a*, 50*b* by a plurality of machine screws (not shown) extending axially through body portions 50*a*, 50*b* and annular flange 54*a*** of the valve guide member.

The upper end 58 of the valve includes and has fastened thereto a piston-forming member 75. Machine bolt 76 is provided to fasten the piston-forming member to valve end 58. A coil return spring 78 is disposed between the facing annular shoulders of the piston-forming member 75 and valve guide member 54.

As shown in FIG. 1, valve piston-forming member includes a tubular portion 80 received on valve end 58 and an annular valve piston portion 82 slidably received in a cylinder or chamber 84 defined in the upper portion **50*a*** of the valve body.

Figure 3:
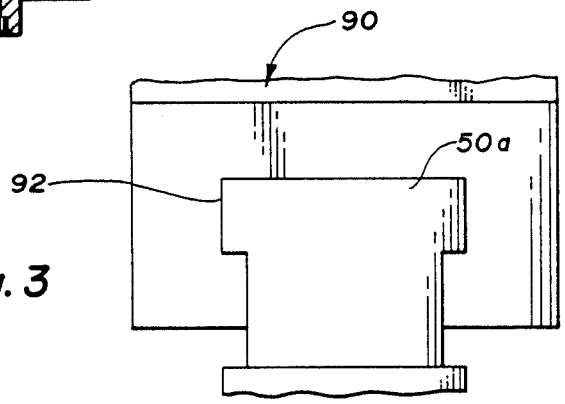
FIG. 3 is a partial elevational view taken along lines 4—4 of FIG. 1.
Figure 4:
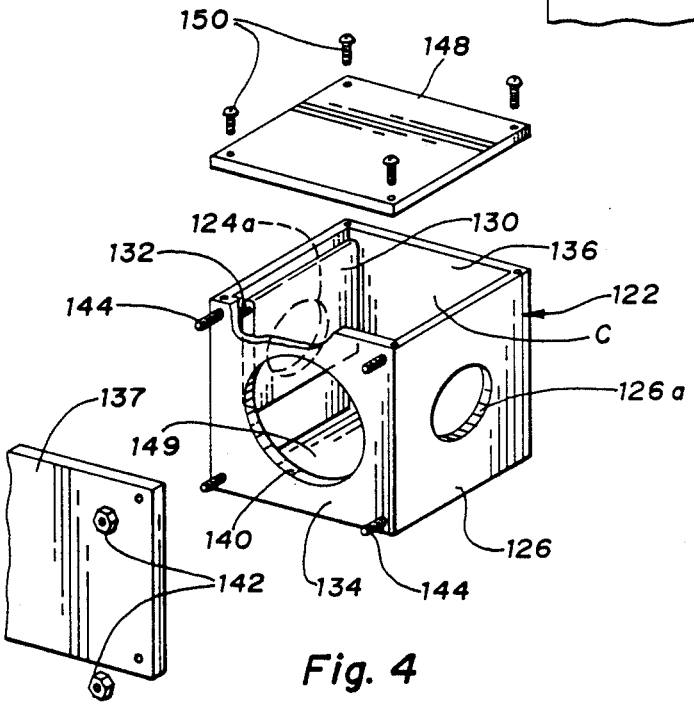
FIG. 4 is a perspective partially exploded view of the gas flow indicator shown in FIG. 1.

Valve body 50 is movable toward and away from discharge chamber 36 by means of support frame 90 that includes a T-shaped receptacle 92 to releasably receive and carry upper portion 50a of the valve body that is provided with a complementary outer T-shape to this end, e.g., see FIG. 3. A fluid actuated piston 96 is connected to the support frame to move the frame and thus valve body 50 toward the discharge chamber 36 to insert the valve body therein prior to injection of a melt into the mold cavity or away from the discharge chamber 36 to remove the valve body after melt injection to allow removal of a casting or solidified part from the mold cavity by separating movable mold half 12 from stationary mold half 10.

In a typical process sequence for gas removal during die casting, valve 55 is moved from the closed position shown in phantom to the open position shown in solid in FIG. 1 prior to insertion of the valve body 50 in the gas discharge chamber 36 after mold halves 10,12 are closed. Such valve movement is effected by introduction of pneumatic pressure to chamber 84 through pneumatic supply line 100 that is connected to a conventional source 102 of pneumatic pressure. A valve 103 connects supply line 100 to either source 102 or to exhaust. The supply line introduces pneumatic pressure through a supply inlet port 106 communicating to chamber 84.

Although the control valve 55 is described as being moved from the closed position to the open position by introducing pneumatic pressure through inlet port 106, those skilled in the art will appreciate that other means such as hydraulic, mechanical or electrical devices can be used to move the valve.

Figure 2:
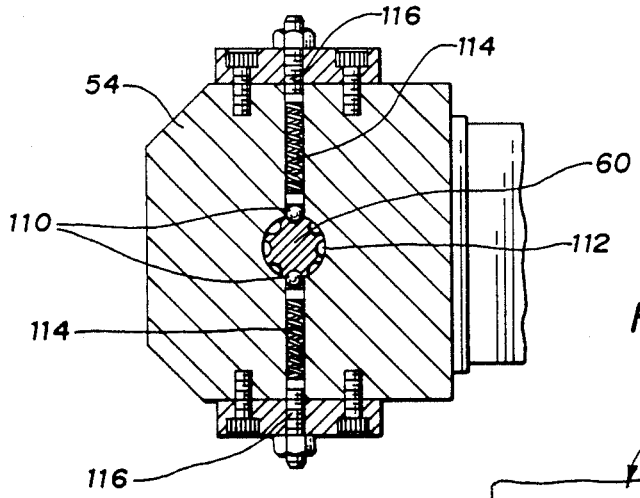
FIG. 2 is a cross-sectional view taken along lines 2—2 of FIG. 1.

Once the valve 55 is moved to the open position of FIG. 1, the valve is held in this position by steel balls 110 engaging in grooves 112 in the valve stem 60 as shown in FIG. 2. Balls 110 are biased against valve stem 60 by coil springs 114. The spring force is adjustable by screws 116 to hold the valve in the open position against bias of spring 78. Balls 110, springs 114 and adjusting screws 116 are disposed in lateral opposed bores in the valve guide member 54 as shown.

Pneumatic supply line 100 and inlet port 106 are connected to exhaust once the valve is moved to the open position and held there by engagement with balls 110.

Movement of valve 55 from the open position back to the closed position shown in phantom is initiated by impingement of the melt or charge injected into the mold cavity 14. As is known, the melt advances into discharge passages 32,34 and into impingement chamber 70 against the valve head 56 to initiate valve closing. Return spring 78 assists return of the valve to the closed position to prevent communication between the discharge chambers 36 and 62. As is known, the valve body 50 is withdrawn from gas discharge chamber 36 after melt injection into the mold cavity and mold halves 10,12 are separated so that the solidified casting can be removed from the cavity.

In accordance with the invention, the gas evacuation system described hereinabove is provided with a gas flow indicator 120 in vacuum conduit 65 as shown in FIG. 1. The gas flow indicator includes a hollow metal housing 122 shown as cubical in shape and as including opposite sides 124,126. Side 124 has opening **124*a* in which is sealingly received the portion of the vacuum conduit extending from extension 64 on valve housing 50 to allow gas flow to enter chamber C of the housing and side 126 has opening 126*a* in which is sealingly received the portion of the vacuum conduit extending to vacuum pump 68 to allow gas flow to exit chamber C. In this way, gas flow from the mold cavity and through the vacuum conduit will flow through housing 120 from side 124 to side 126**.

A mechanical flapper 130 is shown hinged by hinge pin 132 between sides 134 and 136 of the housing in substantially parallel relation to sides 124,126 such that the finger is in the path of gas flow from side 124 to side 126 through the housing. With little or no gas flow through housing 120, the flapper depends from the hinge in a vertical position P1. However, when vacuum pump 68 is actuated to evacuate gases from mold cavity 14 with valve 55 open, the flapper will be moved to an angularly raised position P2 shown in phantom in FIG. 1 and will pause in that position for a period of time while gas is evacuated from the mold cavity and intervening conduit 65. Then, the flapper will return to the vertical position. If valve 55 is improperly closed, gases in the mold cavity 14 will not be evacuated. Only gases in conduit 65 will be evacuated. As a result, the flapper will be raised to position P2 and then return to the initial vertical position P1 in a relatively short time compared to the time for flapper raising and lowering when the valve 55 is in the open position. Thus, flapper 130 will move in one manner in response to evacuation of gas from the mold cavity with valve 55 open and another manner when valve 55 is improperly closed to prevent evacuation of the mold cavity.

Flapper 130 may be a hinged rigid member or a flexible member attached between sides 134,136 and movable to different positions by virtue of its flexibility.

Side 134 of the housing includes a circular window 140 through which a machine operator can observe this movement of flapper 130. A removable transparent side 137 is removably retained against side 134 by threaded nuts 142 threaded onto threaded studs 144 extending from side 134 of the housing. A seal (not shown) is disposed between transparent side 137 and side 134 of the housing.

Top side 148 of the housing may be removably attached to sides 124,126 and 134,136 as by screws 150 to provide access to flapper 130 in chamber C. Bottom side 149 likewise may be removably attached or integral with sides 124,126 and 134,136.

Gas flow indicator 120 preferably is positioned in vacuum conduit 65 at a location remote from valve housing 50 to minimize exposure to the extreme heat, smoke, metal flash and mechanical shock from opening and closing of mold halves 10,12 and melt injection.

In operation of the gas evacuation system of the invention, valve 55 is moved from the closed position to the open position shown in FIG. 1 prior to insertion of valve body 50 in gas discharge chamber 36 after mold halves 10,12 are closed. Once valve 55 is opened, it is held in this position by steel balls 110 engaging in grooves 112.

Vacuum pump 68 is actuated to evacuate mold cavity 14 once the valve body 50 is inserted in gas discharge chamber 36 and until slightly after valve 55 is closed after axial melt impingement thereon.

If valve 55 is properly open, gas will flow from mold cavity 14 through discharge chambers 36,62 and through vacuum conduit 65. The gas flow will pass through housing 120 from side 124 to side 126 and flapper 130 will move to the raised position P2 shown in phantom in FIG. 2 and pause in that position until the mold cavity is fully evacuated. Thereafter, the flapper will return to its original position P1. This movement indicates to the machine operator observing through side 137 and window 140 that valve 55 is properly open and vacuum pump 68 is properly evacuating the mold cavity. Smoke generated as a result of the high temperature of the mold halves 10,12 is also visible passing through housing 120.

However, if valve 55 is improperly closed, only gases in conduit 65 will be evacuated through vacuum conduit 65 and housing 120. Flapper 130 will be raised to position P2 and return to the position P1 shown in solid in FIG. 1 in a noticeably shorter time than when the valve is open and indicate to the machine operator observing through window 140 that the gas evacuation system is not operating properly as a result of valve 55 being improperly closed. The machine operator is also likely to notice that no smoke is passing through housing 120. The machine operator can then take corrective action and shut down the die casting machine until the gas evacuation system is operating properly.

While the invention has been described by a detailed descrition of certain specific and preferred embodiments, it is to be understood that various modifications and changes can be made therein within the scope of the appended claims which are intended to include equivalents of such embodiments.

I claim:

1. A gas evacuation system incorporated with a mold for evacuating gas from a mold cavity, said system comprising a vacuum source, a vacuum conduit disposed between the mold cavity and source, a valve disposed in the vacuum conduit between the mold cavity and source and movable to an open position where the mold cavity is interconnected to the source through the vacuum conduit or to a closed position where the mold cavity is not so interconnected, and a gas flow indicator disposed in the vacuum conduit between said valve and source, said gas flow indicator including a flapper movable in a particular manner in response to evacuation of gas from the mold cavity and window means for viewing flapper movement to indicate whether the gas evacuation system is operative to remove gas from the mold cavity.

2. The system of claim 1 wherein the gas flow indicator includes a housing connected in the vacuum conduit and flapper is hingedly mounted on the housing.

3. The system of claim 2 wherein the housing includes opposite sides, one side connected through the vacuum conduit to the valve and the other side connected through the vacuum conduit to the vacuum source.

4. The system of claim 3 wherein the flapper is mounted between said sides substantially parallel thereto.

5. A gas evacuation system incorporated with a mold for evacuating gas from a mold cavity, said system comprising a vacuum pump, a vacuum conduit extending between the mold cavity and pump, a valve disposed in the vacuum conduit between the mold cavity and vacuum pump and movable to an open position where the mold cavity is interconnected to the vacuum pump through the vacuum conduit or to a closed position where the mold cavity is not so interconnected, and a gas flow indicator disposed in the vacuum conduit between the valve and vacuum pump, said gas flow indicator including a housing connected to the vacuum conduit for gas flow through the housing, a flapper disposed in the housing and movable in a particular manner in response to evacuation of gas from the mold cavity with said valve open and in another manner when substantially no gas is evacuated from the mold cavity as a result of said valve being improperly closed and window means on the housing for viewing the manner of flapper movement to indicate whether the gas evacuation system is operative to remove gas from the mold cavity.

6. A method for evacuating gas from a mold cavity, comprising:

interconnecting the mold cavity and a vacuum source by opening a valve disposed therebetween, positioning a movable flapper between the valve and vacuum source such that the flapper moves in a particular manner in response to evacuation of the mold cavity, and applying a relative vacuum to the mold cavity to evacuate gas therefrom and move the flapper in a manner indicating that gas is being evacuated from the mold cavity with the valve open.

* * * * *